US006846274B2

(12) United States Patent
Lopez-Santillana et al.

(10) Patent No.: US 6,846,274 B2
(45) Date of Patent: Jan. 25, 2005

(54) HEATSINK FOR COOLING POWER COMPONENTS

(75) Inventors: Juan-Luis Lopez-Santillana, Edmonds, WA (US); Laurentiu Olariu, Bellevue, WA (US)

(73) Assignee: Precor Incorporated, Woodinville, WA (US)

( * ) Notice: Subject to any disclaimer, the term of this patent is extended or adjusted under 35 U.S.C. 154(b) by 159 days.

(21) Appl. No.: 10/187,080

(22) Filed: Jun. 28, 2002

(65) Prior Publication Data

US 2004/0002406 A1 Jan. 1, 2004

(51) Int. Cl.[7] ..... A63B 22/00
(52) U.S. Cl. ..... 482/54; 482/51
(58) Field of Search ..... 482/51, 54; 361/697

(56) References Cited

U.S. PATENT DOCUMENTS

| | | | | |
|---|---|---|---|---|
| 3,518,467 A | | 6/1970 | Wightman | |
| 4,742,257 A | | 5/1988 | Carpenter | |
| 4,908,538 A | | 3/1990 | Geberth, Jr. | |
| 5,102,380 A | | 4/1992 | Jacobson et al. | |
| 5,302,162 A | | 4/1994 | Pasero | |
| 5,341,074 A | | 8/1994 | Zorzolo | |
| 5,433,678 A | | 7/1995 | Chi | |
| 5,561,325 A | * | 10/1996 | Ueno et al. | 257/718 |
| 5,563,461 A | | 10/1996 | Daniels | |
| 5,665,032 A | | 9/1997 | Chen | |
| 5,763,969 A | | 6/1998 | Metheny et al. | |
| 5,780,946 A | | 7/1998 | Nakamura et al. | |
| 5,833,577 A | | 11/1998 | Hurt | |
| 6,300,694 B1 | | 10/2001 | Wang et al. | |
| 6,478,720 B1 | * | 11/2002 | Barker | 482/54 |
| 6,538,888 B1 | * | 3/2003 | Wei et al. | 361/697 |
| 6,550,732 B1 | * | 4/2003 | Tuttle et al. | 248/225.21 |

* cited by examiner

*Primary Examiner*—Glenn E. Richmon
(74) *Attorney, Agent, or Firm*—Christensen, O'Connor

(57) ABSTRACT

An exercise device is described having a motor assembly (28) and an electronic control system (36) including a circuit board (40) and electronic components for controlling the exercise device and the motor power output. The main heat-generating electronic components are accumulated into a power control module (44) that is attached to one side of the circuit board. A cooling system (50) is connected to the power control module. The cooling system has a heatsink (60) and a fan (62). In one embodiment, the heatsink includes a base plate (64) that contacts the power control module and a plurality of fins (66) projecting in an array from the other side of the base plate. A fan is positioned within the circle of fins to blow cooling air thereover. The fan is preferably powered by a source independent of the motor power output.

23 Claims, 4 Drawing Sheets

HEATSINK FOR COOLING POWER COMPONENTS

FIELD OF THE INVENTION

This invention relates to exercise apparatus, more particularly, to a system for providing cooling to electronic components in a treadmill device.

BACKGROUND OF THE INVENTION

In an effort to improve one's health, many people regularly exercise by walking, jogging, stepping, or running along a traveling surface of an exercise device, such as a treadmill. There have been many improvements and new developments in exercise devices over the years, including the use of electronic components to control and regulate the device. Such electronic components greatly enhance the functions available to the user in operating the device and allow more efficient control over the motor during use.

Normally, the electronic components include a central printed circuit board to which is attached various electronic components and a large, upright heatsink. A number of the electronic components generate a significant amount of heat, particularly the power generation components, the heat from which is then partially transferred to the upright heatsink. As the temperature of the power generation components increases, the efficiency of the parts decreases and their lifespan becomes affected. If the parts become too hot, they will discontinue working. It is known to use an adjacent fan to blow cool air over the entire collection of electronic components and large heatsink. Such an arrangement does improve the workings and longevity of the electronic components, however, it does so indiscriminately, i.e., all components receive essentially the same amount of cooling regardless of the amount of heat that they produce or hold.

It would therefore be advantageous to overcome the limitations in the prior art cooling systems by providing a cooling system that selectively and more effectively cools those electronic components that produce the most amount of heat. Such a system would improve the workings of the electronic components and, as a result, would further improve the lifespan of the device.

SUMMARY OF THE INVENTION

The present invention is directed to providing selective cooling to the electronic components in exercise devices and meeting other needs as described herein.

In accordance with aspects of the present invention, an exercise device is described having a motor assembly and an electronic control system including a circuit board and electronic components for controlling the exercise device and the motor power output. The main heat-generating electronic components are accumulated into a power control module that is attached to the circuit board. A cooling system is connected to the power control module. The cooling system has a heatsink and a fan. In one embodiment, the heatsink includes a base plate that contacts the power control module and a plurality of fins projecting in an array from the other side of the base plate. A fan is positioned within the circle of fins to blow cooling air thereover. The fan is preferably powered by a source independent of the motor power output.

In accordance with other aspects of the invention, the exercise device is a treadmill having a frame, forward and rear roller assemblies mounted on the frame, an endless belt trained about the forward and rear roller assemblies for providing an exercise surface, and an electric motor connected to one of the forward and rear roller assemblies. In one embodiment, the circuit board is positioned in a forward enclosure at an angled orientation. In another embodiment, the circuit board is positioned in a forward enclosure in a vertical orientation.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION OF THE PREFERRED EMBODIMENT

It will be readily understood that the components of the present invention, as generally described and illustrated in the FIGURES herein, can be arranged and designed in a wide variety of different configurations. Thus, the following detailed description of the embodiments of the system and method of the present invention, as represented in FIGS. 1–4, is not intended to limit the scope of the invention, as claimed, but is merely representative of the presently preferred embodiments of the invention.

Figure 1:
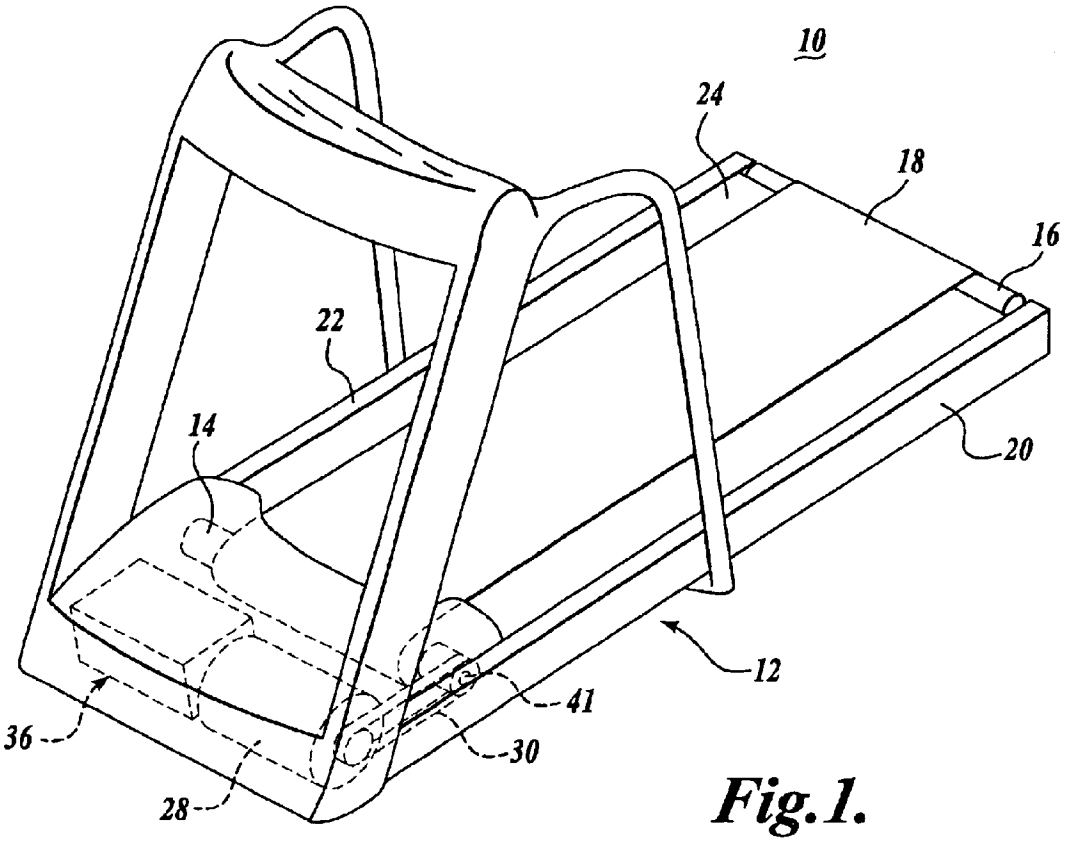
FIG. 1 is a schematic perspective view of a treadmill formed in accordance with the present invention.

Referring to FIG. 1, an exemplary piece of exercise equipment is shown in the form of a treadmill 10. The treadmill 10 includes a frame 12 on opposite ends of which are transversely mounted a forward roller assembly 14 and a rear roller assembly 16. An endless belt 18 is trained about the forward roller assembly 14 and rear roller assembly 16. The treadmill frame 12 includes first and second longitudinal side rail members 20 and 22. The side rail members 20 and 22 are spaced apart and are joined by crossmembers (not shown), as is well-known for treadmill frame construction. The forward roller assembly 14 is rotatably mounted on bearings (not shown) on a front axle 41. The front axle 41 is disposed transversely relative to the longitudinal frame members 20 and 22. A rigid deck 24 spans between, and is supported above, the first and second frame side rail members 20 and 22. The upper run of the belt 18 is supported by the rigid deck 24. As used here and throughout, "forward" refers to the direction in which an exerciser faces when using the treadmill. The terms "rear" and "rearward" refer to the opposite direction. An enclosure is provided at the forward end of the treadmill for housing a motor assembly 28 and an electronic control system 36. The motor assembly 28 is connected to the front axle 41 via a drivebelt 30. Translation of the drivebelt 30 by the motor assembly 28 causes rotation of the axle 41 and corresponding movement of the endless belt 18.

Figure 2:
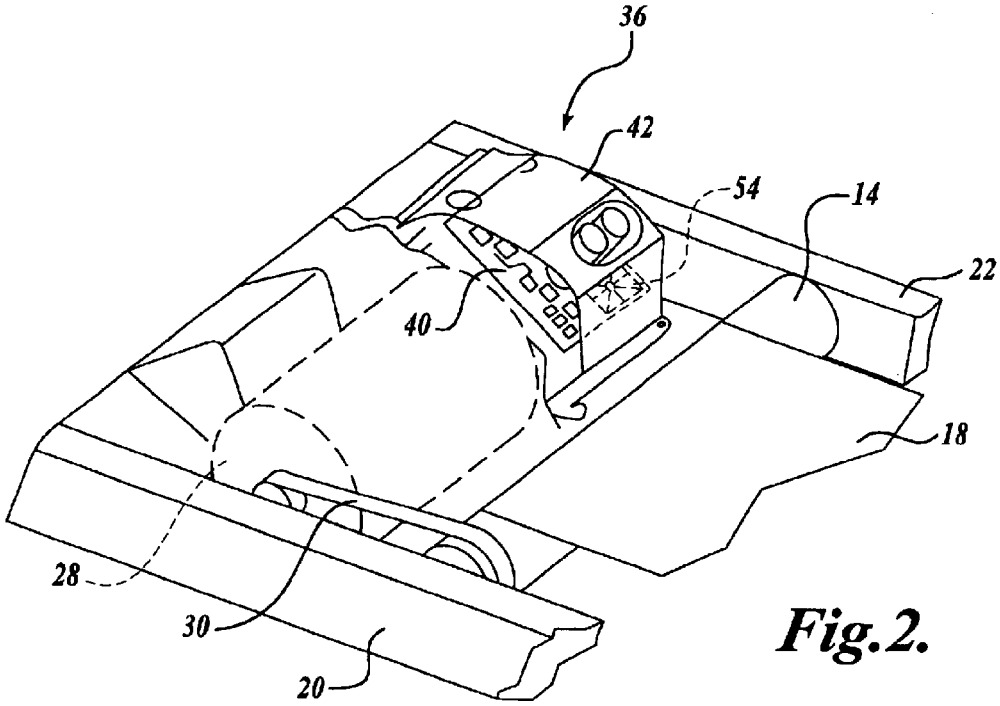
FIG. 2 is a schematic perspective view of one embodiment of the forward portion of a treadmill formed in accordance with the present invention.
Figure 3:
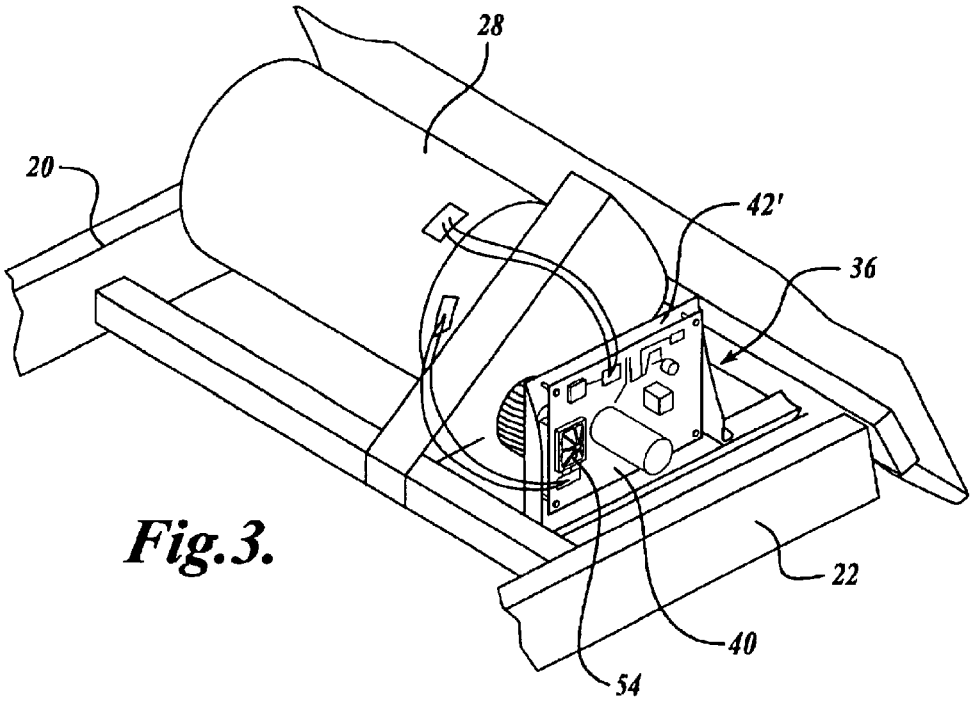
FIG. 3 is a schematic perspective view of another embodiment of the forward portion of a treadmill formed in accordance with the present invention.

The electronic control system 36 provides power and control to the motor assembly during use. In the embodiment of FIG. 2, the electronic control system 36 includes a printed circuit board 40 attached to a multisided bracket 42. The combination is mounted within the enclosure and is oriented at an angle along one end of the motor assembly 28, opposite the motor connection to the drivebelt 30. In the embodiment of FIG. 3, the board 40 and a generally flat bracket 42' are vertically positioned at a similar location.

In both configurations, a number of electronic components are connected to the circuit board 40, including a power control module 44 to regulate the power output of the motor assembly 28. The power control module 44 includes conventional items, such as rectifiers, isolated bipolar transistors (IGBTs), and diodes. These components can generate a significant amount of heat during operation of the exercise device. According to the present invention, these components are grouped together (e.g., within the power control module 44) and placed along the underside of the circuit board. A cooling system 50 is then directly connected to the other side of the module.

Figure 4:
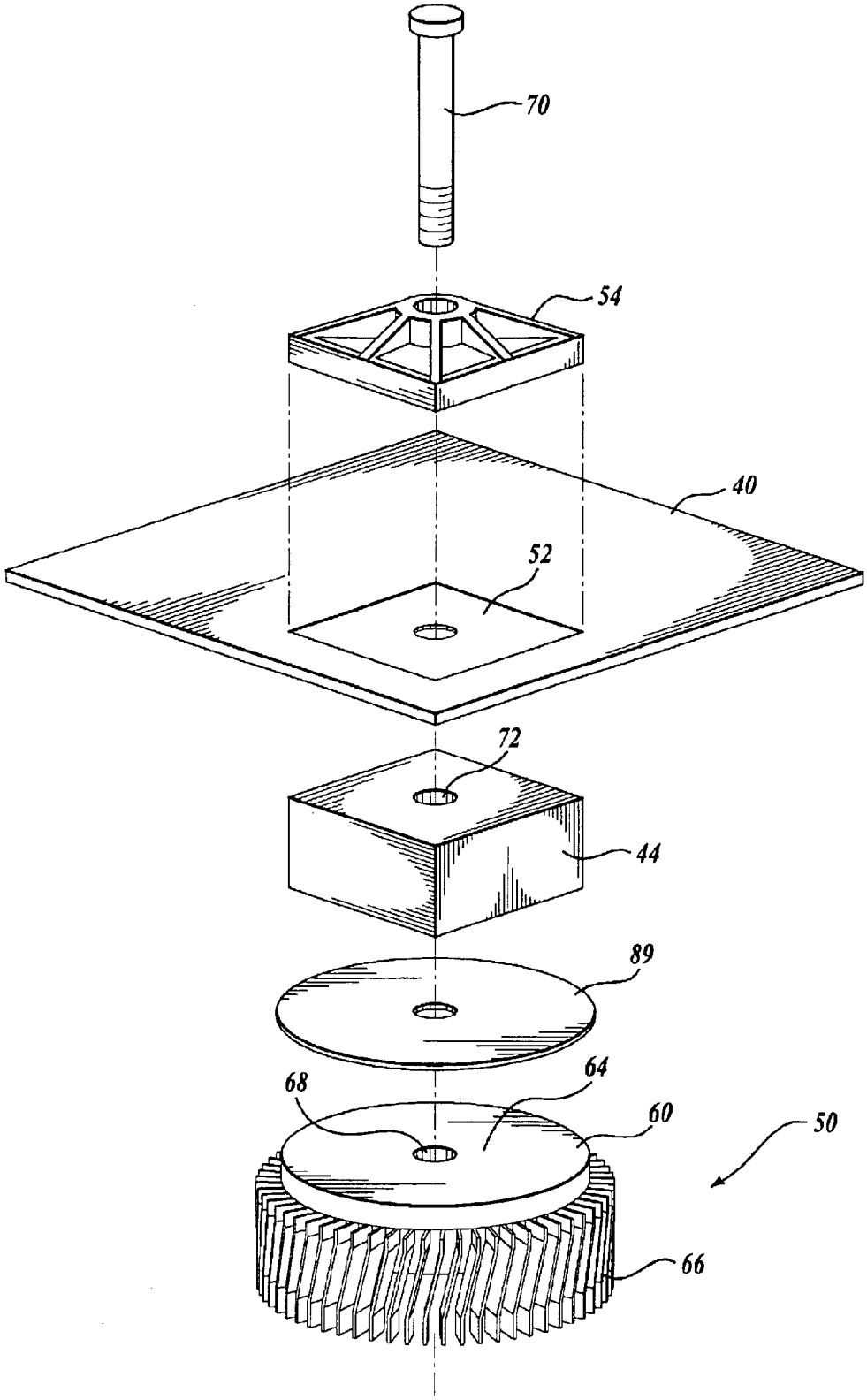
FIG. 4 is an exploded perspective view of a circuit board with consolidated power control components and one embodiment of a cooling system formed in accordance with the present invention.

FIG. 4 is an exploded view of the present invention illustrating one method by which the power control module 44 may be attached to the circuit board 40. The module is placed on the underside of the board. The board includes the appropriate connections in the area of the location of the module (labeled square 52). A support member 54 is provided above the circuit board and essentially sandwiches the board between the support member 54 and the power control module 44. The support member 54 serves to mount and stabilize the power control module 44 to the circuit board 40.

The cooling system 50 is located adjacent the lower side of the power control module 44. The cooling system 50 includes a heatsink 60 and a fan 62 (see FIG. 5). In the embodiment shown, the heatsink 60 is an integrally formed cylindrical metal object having a circular base 64 and a series of fins 66 that extend from the base 64 in a circular array. The fins 66 have an S-shape, though other shapes and sizes may be used. These S-shaped fins are similar to the ones provided in product DU0462-9, manufactured by ThermalTake of Walnut, Calif. Of course, the heatsink may be of other shapes, such as square or hexagonal, and the fins may be arranged in other arrays.

The base 64 includes a tapped axial bore 68 for engaging a threaded fastener 70. See FIG. 5. The power control module 44 includes a central passageway 72 to enable the fastener 70 to pass from the support member 54, through the circuit board 40, through the power control module at 72, and into the heatsink bore 68, as assembled.

The fan 62 may be a radial flow fan that pushes cooling air radially outward, over the fins 66 of the heatsink. The fan 62 preferably has enough cooling capacity such that while operating the treadmill, the power control module 44 will remain sufficiently cooled to promote the efficiency and lifespan of its components. In one embodiment, the fan is capable of moving (blowing) roughly 20 cubic feet of air per minute. Power required to operate this particular fan is roughly 2 watts. The base plate may be made of copper.

Figure 5:
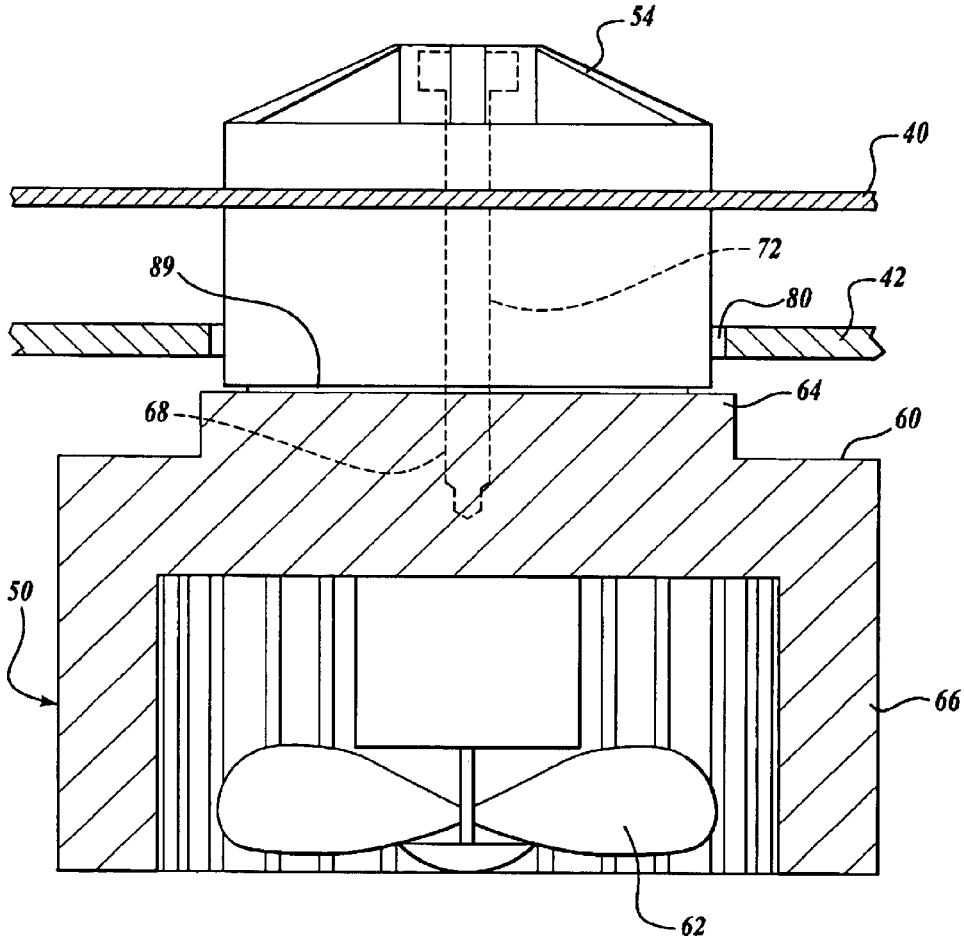
FIG. 5 is a cross-section side view of a circuit board with consolidated power control components and an embodiment of a cooling system formed in accordance with the present invention.

As shown in FIG. 5, a thermal interface layer 89 may be used to improve the heat transfer between the heatsink and the power control module. One thermal interface layer that has shown acceptable results is the Hi-Flow® 105 product, manufactured by The Berquist Company located in Chanhassem, Minn. This particular product is a phase change material available in a pad form. Of course, other types of thermal interface may be used, such as thermal grease, SilPads™, etc.

Referring back to FIG. 2, the power control module 44 is illustrated as being located at the lower outer corner of the circuit board 44. In FIG. 3, the circuit board is oriented longitudinally relative to the treadmill and the power control module 44 is located near the rear edge of the board. In either embodiment, the bracket 42, 42' includes an opening 80 to allow unconflicted passage of the components through the bracket. See FIG. 5.

The cooling system 50 is preferably electrically powered by an independent power source on a power switch separate from the treadmill motor 28 and does not depend on the running of the exercise device motor. This arrangement allows the cooling system to operate effectively regardless of the speed of the motor. When the device is turned on, the cooling system 50 is automatically activated and continues to be engaged until the device is turned off.

Arranging the circuit board 40, power control module 44, and cooling system 50 in this manner allows the heatsink 60 to absorb heat from the power control module 44 and the fan 62 to push cooling air over the heatsink fins 66, which in turn transfer heat away from the power control module 44 and out of the exercise device enclosure.

Although a preferred embodiment of the treadmill motor cooling system has been described above, it should be apparent to those of ordinary skill in the art that various alterations and modifications are possible within the scope of the present invention. For example, the cooling fan could be formed in various configurations, such as a cube shape or as separate assembled components. Additionally, more than one fan could be used to further cool the power control module and heatsink. Also, fans of various types could be used, including axial flow fans as described above, as well as a squirrel-cage type of fan or turbo type of fan, depending on the configuration and location of the heatsink.

The embodiments of the invention in which an exclusive property or privilege is claimed are defined as follows:

1. In an exercise device having a motor with a power output, an improvement comprising:

a power control module including electronic components for regulating the motor power output; and a cooling system for cooling the power control module, the cooling system including a heatsink and a fan, the heatsink coupled to the power control module, the fan being located near the heatsink;

wherein, during use, heat is transferred from the power control module onto the heatsink and the fan blows cooling air over the heatsink, the fan being powered by a source independent of the motor power output.

2. The improvement according to claim 1, wherein the heatsink is a generally cylindrical object including a base plate with opposed first and second surfaces, and a plurality of radial fins projecting from the base plate second surface in an array; at least portions of the base plate first surface contacting the power control module; the fins enhancing heat transfer away from the base plate during operation of the power control module.

3. The improvement according to claim 2, wherein the base plate is positioned between the power control module and the fan, and the heatsink fins are located radially outward of the fan in a circular array; the fan being a radial flow fan.

4. The improvement according to claim 3, wherein the fan has an airflow capacity of approximately 15 to approximately 25 cubic feet of air per minute.

5. The improvement according to claim 1, wherein the power control module includes at least one rectifier, transistor, or diode.

6. The improvement according to claim 1, wherein the heatsink base plate is made of a material that includes copper.

7. The improvement according to claim 1, wherein the fan is electrically powered.

8. The improvement according to claim 1, wherein the cooling system further includes a thermal interface layer located between the heatsink and the power control module.

9. An electronic control system for an exercise device having a motor, the electronic control system including a circuit board and electronic components for controlling the exercise device, the motor having a power output, an improvement comprising:

a power control module including electronic components for controlling the motor power output, the power control module being connected to the circuit board and having a heat transfer face; and a cooling system for cooling the power control module, the cooling system including a heatsink and a fan, the heatsink including a base plate with a heat transfer face and a plurality of fins projecting from the base plate; the base plate being positioned adjacent the power control module so that the heat transfer face of the power control module and the heat transfer face of the heatsink base face are disposed in face-to-face relationship to each other; the fins enhancing heat transfer away from the base plate during operation of the power control module; the fan being located near the heatsink;

wherein, during use, heat is transferred from the power control module into the heatsink and fins, the fan blowing cooling air at least over the fins, the fan being powered by a source independent of the motor power output.

10. The improvement according to claim 9, wherein the circuit board includes a lower surface, the power control module being mounted to the underside surface.

11. The improvement according to claim 10, wherein the circuit board includes an upper surface, the power control module being held to the underside surface of the circuit board by a rigid support member located on the upper surface of the circuit board; a fastener extending through the support member, through the circuit board, through the power control module, and into the heatsink.

12. The improvement according to claim 11, wherein the fastener threads into a hole in the heatsink base plate.

13. The improvement according to claim 12, wherein the base plate fastener hole is tapped.

14. The improvement according to claim 9, wherein the base plate is a cylindrical disc with opposed first and second surfaces; the fins projecting from the base plate second surface in a circular array; the base plate first surface contacting the power control module.

15. The improvement according to claim 14, wherein the base plate is positioned between the power control module and the fan, and the heatsink fins are located radially outward of the fan; the fan being a radial flow fan.

16. The improvement according to claim 15, wherein the fan has an airflow capacity of approximately 15 to approximately 25 cubic feet of air per minute.

17. The improvement according to claim 9, wherein the cooling system further includes a thermal interface layer located between the heatsink and the power control module.

18. An exercise treadmill comprising:

a frame;

a forward roller assembly mounted on the frame to rotate about a forward transverse axis;

a rear roller assembly mounted on the frame to rotate about a rear transverse axis;

an endless belt trained about the forward and rear roller assemblies;

an electric motor having a power output drivingly coupled to one of the forward and rear roller assemblies;

an electronic control system including a power control module to control the motor power output, the power control module including heat-generating electronic components; and a cooling system including a heatsink and a fan, the heatsink being coupled to the power control module to absorb heat from the power control module during use, the fan being located near the heatsink to provide cooling to the heatsink, the fan being operated from an energy source independent of the motor power output.

19. The exercise treadmill according to claim 18, wherein the electronic control system further comprises a circuit board upon which the power control module is mounted; the electronic control system being located at the forward end of the exercise treadmill.

20. The exercise treadmill according to claim 19, wherein the circuit board is positioned in an angled orientation.

21. The exercise treadmill according to claim 19, wherein the circuit board is positioned in a vertical orientation.

22. The exercise treadmill according to claim 18, wherein the cooling system further includes a thermal interface layer located between the heatsink and the power control module.

23. The improvement according to claim 1, wherein the fan is disposed within the envelope defined by the heatsink.

* * * * *